US007941868B1

(12) United States Patent
Shaw

(10) Patent No.: US 7,941,868 B1
(45) Date of Patent: May 17, 2011

(54) DISPOSABLE COLLAR PROTECTOR

(76) Inventor: Jerald Shaw, Lauderdale Lakes, FL (US)

( * ) Notice: Subject to any disclaimer, the term of this patent is extended or adjusted under 35 U.S.C. 154(b) by 0 days.

(21) Appl. No.: 12/719,477

(22) Filed: Mar. 8, 2010

(51) Int. Cl.
*A41D 13/04* (2006.01)
*A41D 27/16* (2006.01)

(52) U.S. Cl. ..... 2/50; 2/60

(58) Field of Classification Search ..... 2/50, 48, 2/49.1–49.5, 46, 47, 51, 52, 60, 88, 92, 129, 2/131, 132, 135, 136, 143, 468, 207, 174, 2/104; D2/860–862, 602
See application file for complete search history.

(56) References Cited

U.S. PATENT DOCUMENTS

| | | | | | |
|---|---|---|---|---|---|
| 1,556,468 | A | * | 10/1925 | Alamo | 2/50 |
| 2,246,035 | A | * | 6/1941 | Elliot | 2/50 |
| 2,282,547 | A | * | 5/1942 | Spanel | 2/48 |
| 2,364,568 | A | * | 12/1944 | Tiscornia | 2/50 |
| 2,492,599 | A | * | 12/1949 | Smith | 2/49.1 |
| 2,523,565 | A | * | 9/1950 | Gardner | 2/49.1 |
| 2,763,867 | A | * | 9/1956 | Chagnon | 2/49.1 |
| 2,808,591 | A | * | 10/1957 | Grant | 2/88 |
| 2,947,004 | A | * | 8/1960 | Pfile | 2/50 |
| 3,747,122 | A | * | 7/1973 | Goldberg | 2/48 |
| 3,857,116 | A | * | 12/1974 | Meeker | 2/50 |
| 3,945,048 | A | * | 3/1976 | Shearer | 2/48 |
| 4,190,903 | A | | 3/1980 | Kinsella | |
| 4,416,025 | A | * | 11/1983 | Moret et al. | 2/49.3 |
| 4,442,552 | A | * | 4/1984 | Bolick et al. | 2/49.1 |
| 5,572,740 | A | | 11/1996 | Geniesse | |
| 5,956,761 | A | | 9/1999 | Capnerhurst | |
| 5,991,919 | A | * | 11/1999 | Baggetto | 2/50 |
| 6,094,744 | A | | 8/2000 | Dibenedetto et al. | |
| 7,080,413 | B1 | * | 7/2006 | Schneider | 2/60 |
| 7,836,518 | B2 | * | 11/2010 | Bloom et al. | 2/50 |
| 2009/0300815 | A1 | * | 12/2009 | Nunez | 2/50 |

* cited by examiner

*Primary Examiner* — Amy B Vanatta
(74) *Attorney, Agent, or Firm* — Mark D. Brown, Esq.; Malin Haley DiMaggio Bowen & Lhota, P.A.

(57) ABSTRACT

A disposable collar protector having an improved structure that allows for rapid and form fitting placement over a wearer's outer collar in surrounding relation with the neck is disclosed. A generally circular, thin sheet of flexible, preferably plastic, structure that includes a notches and cutouts that allow the device to be rapidly deployed into a collar protector while being placed around a person's neck. A radial slit originating at a peripheral edge and leading to a vertex of a generally triangular cutout. Additional slits further form a plurality of generally triangular flaps that may be tucked over the wearer's collar. The peripheral edge further preferably includes opposed peripheral notches that allow the collar protector to drape over the wearer's shoulders. The present invention thus provides an inexpensive and disposable collar protector for use during cosmetology procedures.

3 Claims, 1 Drawing Sheet

DISPOSABLE COLLAR PROTECTOR

CROSS REFERENCE TO RELATED APPLICATIONS

This application claims the benefit of provisional U.S. Patent Application Ser. No. 61/157,577, filed on Mar. 5, 2009.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to the field of cosmetology, and more particularly to a disposable collar protector for use on a customer during hair styling and coloring procedures.

2. Description of Related Art

Cosmetology is the study and application of beauty treatment with specialty branches including hairstyling, skin care, cosmetics, manicures/pedicures, and electrology. A hair stylist specializes in the styling of hair, including cutting, and the application of chemicals, e.g. relaxers, perms, color, and restorative treatments. In view of the common and extensive use of liquids, including liquid chemical agents as well as water a number of protective outer garments have been developed in order to protect the client and the client's clothing from damage or exposure during the treatment process. Normally, the client is provided with an outer smock or robe and a towel is tucked in over the collar around the neck to further protect the client from stains and like damage during hair treatments at beauty salons.

In addition, the background art reveals a number other collar protecting devices. For example, U.S. Pat. No. 4,190,903, issued to Kinsella discloses a neck protector having a fluid absorbent band placeable about the neck in overlapping relation and further includes a wire retaining means. U.S. Pat. No. 5,572,740, issued to Geniesse, discloses a launderable garment for protecting clothing worn by a person comprising two flaps connected to a band and a fastener for closing the band. U.S. Pat. No. 5,956,761, issued to Capnerhust, discloses a jacket for use during hair coloring composed of two layers of plastic film and being disposable. U.S. Pat. No. 6,094,744, issued to Dibenedetto et al., discloses a partial covering to be received within and protect a collar of an outer garment, as well as then cover the shoulder and back portions thereof.

While the devices revealed in the background art appear generally suited to the specific uses for which they are intended, there remains a need for an improved disposable collar protector for placement in covering relation with the collar of a client's outer clothing to protect same from wetness, stains, and like damage during hair treatments.

BRIEF SUMMARY OF THE INVENTION

The present invention overcomes the limitations and disadvantages present in the art by providing a disposable collar protector having an improved structure that allows for rapid and form fitting placement over a wearer's outer collar in surrounding relation with the neck. A collar protector in accordance with the present invention comprises a generally circular, thin sheet of flexible, preferably plastic, structure that includes a notches and cutouts that allow the device to be rapidly deployed into a collar protector while being placed around a person's neck. The circular collar protector includes a radial slit originating at a peripheral edge and leading to a vertex of a generally triangular cutout. Additional slits further form a plurality of generally triangular flaps that may be tucked over the wearer's collar. The peripheral edge further preferably includes opposed peripheral notches that allow the collar protector to drape over the wearer's shoulders. The present invention thus provides an inexpensive and disposable collar protector for use during cosmetology procedures.

Accordingly, it is an object of the present invention to provide an improved collar protector.

A further object of the present invention is to provide such a collar protector that is disposable.

Yet another object of the present invention is to provide a collar protector formed of a single, generally circular sheet of material by simple slits and cutouts.

In accordance with these and other objects, which will become apparent hereinafter, the instant invention will now be described with particular reference to the accompanying drawings.

DETAILED DESCRIPTION OF THE INVENTION

Figure 1:
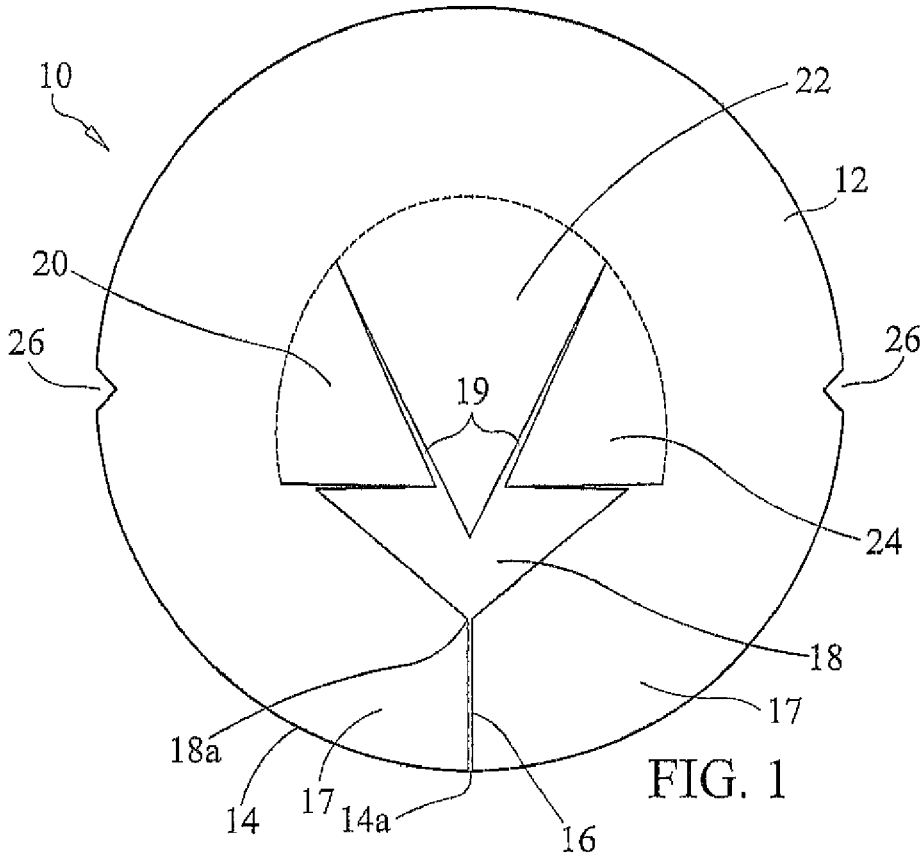
FIG. 1 is a top plan view of a disposable collar protector in accordance with the present invention.
Figure 2:
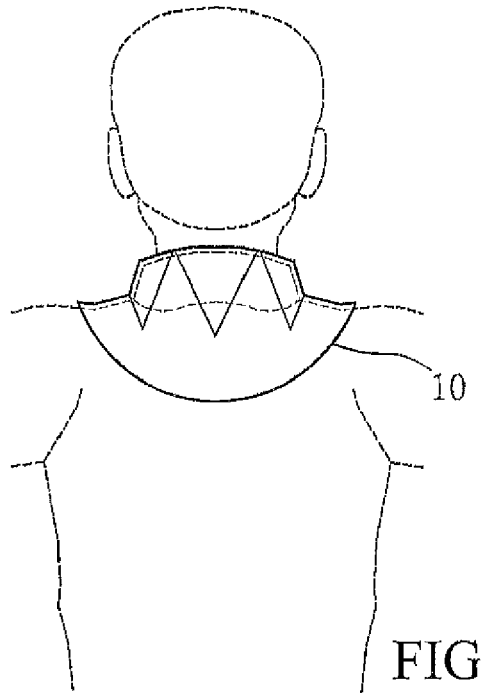
FIG. 2 illustrates the collar protector deployed for use on a wearer.

With reference now to the drawings, FIGS. 1-2 depict a disposable collar protector, generally referenced as 10, having an improved structure that allows for rapid and form fitting placement over a wearer's outer collar in surrounding relation with the neck in accordance with the present invention. Collar protector 10 is preferably fabricated from thin sheets of plastic so as to minimize material costs with the goal of packaging a large number of collar protectors 10 in packaging that allows for individual dispensing as needed.

In a preferred embodiment, collar protector 10 is a generally circular thin sheet of flexible water-impervious material designed to be rapidly deployed into a collar protector while being placed around a person's neck. The water-impervious material is preferably a thin transparent sheet formed of a plastic or polymer material, however any suitable material may be used. The characteristics, however, of disposability and water imperviousness are considered important aspects of the present invention.

Collar 10 is preferably generally circular in shape, and sized with a diameter of approximately 1.5-2.0 feet. Collar protector 10 includes a main body 12 defining a generally circular peripheral edge 14. A slit 16 defined between flaps 17 originates at a first point, referenced as 14*a*, along peripheral edge 14 and extends radially inward and leading to a vertex 18*a* of a generally triangular cutout 18. Additional slits 19 form a plurality of generally triangular flaps, referenced as 20, 22, and 24 that may be tucked over the wearer's collar when in use. Flaps 20, 22, and 24 function, by folding downward over the top and inner portion of the collar to provide a water impervious structure to prevent liquid from contacting the collar thereby protecting it from wetness, discoloration, and related damage. Peripheral edge 14 further defines a pair of diametrically opposed notches, referenced as 26 that allow the collar protector to drape over the wearer's shoulders. Notches 26 are preferably each disposed approximately 90-degrees on opposite sides of slit 16 as best seen in FIG. 1.

The collar protector of the present invention is deployed for use by wrapping the device around a person's neck, such as by separating flaps 17 formed by slit 16 whereby the neck is allowed to pass there between. Flaps 20, 22, and 24 are then folded downwardly over the collar of the wearer and tucked between the inner collar and the wearer's neck/body to provide a water impervious structure to prevent liquid from contacting the collar thereby protecting it from wetness, discoloration, and related damage. Notches 26 are generally aligned with the wearer's shoulders and allow collar protector 10 to drape the front and back of the wearer. Flaps 17 are preferably disposed in overlapping relation over the front of the wearer and may be secured by a clip, hook and loop fastening material, tape or adhesive, or any other securing structure. In and alternate embodiment, flaps 17 may be provided with means for securing, such as adhesive, or hook and loop fastening material. The present invention thus provides an inexpensive and disposable collar protector for use during cosmetology procedures.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A collar protector comprising:

a generally circular thin sheet of flexible water-impervious material;

said generally circular sheet having a peripheral edge and a diameter of approximately between 1.5 feet and 2.0 feet;

said peripheral edge defining a first slit extending radially inward and leading to the vertex of a generally triangular cutout;

a pair of front flaps, each flap defined by a portion of said peripheral edge and internal edges defining a boundary along said slit and said cutout;

a plurality of second slits forming a plurality of generally triangular flaps disposed in the central region of said circular sheet; and whereby said collar protector is deployed in covering relation on a collar by folding said triangular flaps downward over the top and inner portion of the collar, and securing said front flaps in overlapping relation over the front of the wearer to provide a water impervious structure to prevent liquid from contacting the collar.

2. A collar protector according to claim 1, wherein said front flaps are provided with means for fastening said flaps together.

3. A collar protector according to claim 1, wherein said peripheral edge further defines a pair of diametrically opposed notches, each notch angularly disposed approximately 90-degrees relative to said first slit, said notches allowing said generally circular sheet to drape over a person's shoulders.

* * * * *